US008207910B2

(12) United States Patent
Kuiken et al.

(10) Patent No.: US 8,207,910 B2
(45) **Date of Patent: *Jun. 26, 2012**

(54) INFORMATION PRESENTATION DEVICE

(75) Inventors: Martijn Kuiken, AZ Veendam (NL); Erwin Weinans, PH Klijndijk (NL); Dick de Jong, BW Emmen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 907 days.

This patent is subject to a terminal disclaimer.

(21) Appl. No.: 12/256,983

(22) Filed: Oct. 23, 2008

(65) Prior Publication Data

US 2010/0103080 A1 Apr. 29, 2010

(51) Int. Cl.
*G09G 3/00* (2006.01)

(52) U.S. Cl. ..... 345/31; 345/157; 345/649

(58) Field of Classification Search ..... 345/31, 345/169, 649, 156–158

See application file for complete search history.

(56) References Cited

U.S. PATENT DOCUMENTS

2006/0262143 A1* 11/2006 Harris ..... 345/649
2006/0262144 A1* 11/2006 Harris ..... 345/649
2007/0035564 A1* 2/2007 Katsuyama ..... 345/649
2007/0157084 A1* 7/2007 Yano et al. ..... 715/527
2009/0002270 A1* 1/2009 Chui ..... 345/31
2009/0002272 A1* 1/2009 Chui ..... 345/31
2009/0002273 A1* 1/2009 Chui ..... 345/31
2009/0141045 A1* 6/2009 Jackson ..... 345/649
2009/0251406 A1* 10/2009 Seibert et al. ..... 345/156
2010/0103079 A1* 4/2010 Kuiken et al. ..... 345/31

* cited by examiner

*Primary Examiner* — Kimnhung Nguyen
(74) *Attorney, Agent, or Firm* — Renner, Otto, Boisselle & Sklar, LLP

(57) ABSTRACT

The present invention relates to a device and a method for presentation of information on a display. The method performs obtaining information to be presented on an information presentation unit, presenting information on the information presentation unit, presenting a selection area on the information presentation unit, determining mode for updating information on information presentation unit, in dependence of user input, detecting a rotational motion around an axis of rotation of an information presentation device, and providing either the selected area at an updated position on the information presentation unit or the presented information at an updated position on the information presentation unit, in dependence of the detection of rotational motion and in dependence of obtained user input, enabling the selection area or the information to rotate according to detected rotational motion around an axis of rotation of the information presentation device.

6 Claims, 7 Drawing Sheets

INFORMATION PRESENTATION DEVICE

TECHNICAL FIELD

The present invention relates in general to a device and a method for presentation of information and in particular to a device and a method for presentation of information in dependence of changes in rotation of an information presentation device.

BACKGROUND

Information presentation units, such as displays, are comprised in a large variety of portable electronic devices, such as mobile phones.

The size of mobile phones has roughly decreased over the past years, whereas the size of the information presentation units has increased.

An alternative to presenting information on a large singular display is to present information on two or more displays. In mobile phones, this has been applied by using for instance a top and a bottom side of a mobile phone.

However, there is a demand for even larger displays or screens for presentation of information.

Another alternative to the provision of larger displays is to provide phones that have two parts that can be slid in relation to one another, by which practically the entire surface of an upper part may be provided as a display. In this way buttons can be provided in the lower part, making practically all space of the upper part available for the display.

Nevertheless, there is a demand to provide alternative solutions to the problem of presenting information on portable electronic devices.

SUMMARY

The present invention is directed towards providing an alternative device and method for presenting information to a user.

According to an aspect of the present invention, there is provided an information presentation device for presentation of data information, the information presentation device comprising an information presentation unit arranged to present data information to a user, a user input unit for receiving user input, and a presentation controlling unit connected to the information presentation unit, said presentation controlling unit being arranged to control the presentation of the information on the information presentation unit, and arranged to present a selection area related to the presented information, wherein either the data information or the selection area is presented in dependence of physical rotation around an axis of rotation of the information presentation device, in dependence of user input.

Said presentation controlling unit of the information presentation device may further be arranged to determine physical rotation around the axis of rotation of the information presentation device and arranged to position the selection area in dependence of the determined rotation.

Said presentation controlling unit of the information presentation device may further be arranged to determine physical rotation around the axis of rotation of the information presentation device and arranged to provide the presentation of information in dependence of the determined rotation.

Said information presentation unit of the information presentation device may further have a substantially rotation symmetric shape around the axis of rotation, and where the information presentation unit covers at least substantially the entire turn around the envelope surface of the rotation symmetric shape.

The information presentation device may further comprise a mobile phone.

According to another aspect of the present invention, there is provided a method for controlling an information presentation unit adapted to present data information, comprising the steps of obtaining information to be presented on an information presentation unit, presenting information on the information presentation unit, presenting a selection area on the information presentation unit, determining mode for updating information on information presentation unit, in dependence of user input, detecting a rotational motion around an axis of rotation of an information presentation device, and providing either the selected area at an updated position on the information presentation unit or the presented information at an updated position on the information presentation unit, in dependence of the detection of rotational motion and in dependence of obtained user input, enabling the selection area or the information to rotate according to detected rotational motion around an axis of rotation of the information presentation device.

Enabling changing the position of the selection area in relation, provides the advantage that a user can more easily make use of such functionality for, for instance, selecting data positioned within the selection area for further activities.

Information or the selection area may appear as fixed to the display, as an effect of small updating steps, and will hence not jump upon updating of the presentation of the information presentation unit. This is much appreciated by a user since updated information and selection area will not be experienced as tiresome for a user's eyes.

An advantage of at least some embodiments of the present invention is an improved visual experience of the information to be presented, since the position of the selection area, that may for instance comprise information to be activated, can easily be adjusted.

It should be emphasized that the term "comprises/comprising" when being used in the specification is taken to specify the presence of the stated features, integers, steps or components but does not preclude the presence or addition of one or more other features, integers, steps or components or groups thereof.

BRIEF DESCRIPTION OF THE DRAWINGS

In order to explain the invention and the advantages and features thereof in more detail, embodiments will be described below, references being made to the accompanying drawings, in which.

DETAILED DESCRIPTION

When presenting information of a display or a screen, especially when presenting information with portions of content-rich information and portions with content-poor information, such as list type information that may be in the form of text information, the information presentation device according to a number of embodiments of the present invention provides a valuable tool, as an alternative to the displays and screens known today.

With reference to the figures as presented above, a few preferred embodiments of the present invention are now explained.

Figure 1:
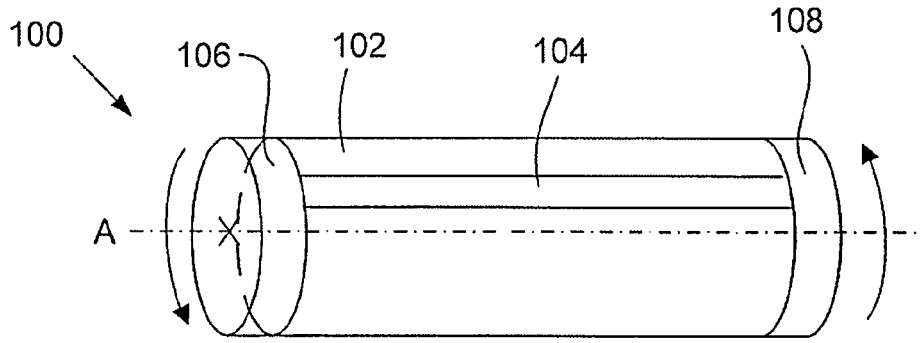
FIG. 1 illustrates an information presentation device according to some embodiments of the present invention.

In FIG. 1 an information presentation device 100 according to some embodiments is illustrated, which information presentation device comprises at least one information presentation unit 102. The information presentation unit may be a display or a screen.

A selection area 104, can also be presented on the information presentation unit 102 of the information presentation device 100. The selection area 104 may also be regarded as a cursor area.

In addition, a user input unit and a grip area, marked as 106 and 108, respectively, may also be comprised in the information presentation device 100

The user input unit may be realized as a push key, as a slidable key or switch, as a wheel or in any other way.

The user input unit 106 may also function as a grip area, and the grip area 108 may alternatively also comprise a user input unit.

The information presentation device is suitable for presentation of content-rich and content-poor information portions, such as list type information. Content-rich information portion may be regarded as the list items, and the content-poor information portions may be regarded as space in-between said items.

Another example of content-rich and content-poor information portions, may be text lines with line spacing provided between the text lines.

However, other types of information may also be presented on the information presentation device, such as continuous information such as pictures or videos.

The information presentation unit may cover the entire turn or at least substantially the entire turn of the information presentation device.

For technical reasons it may be difficult to produce a display covering an entire turn, for which reason substantially the entire turn may be provided as an information presentation unit.

The information presentation unit being a part of the information presentation device may have a cylindrical shape, which information presentation unit may be realised in the form of a display, and may cover the entire turn and may therefore appear as to be endless when viewing the entire display.

Viewing the display from one side perpendicular to the axis of rotation, in case of a rotation symmetric information presentation device, information can be presented just as reading or viewing a list of information from a white paper sheet. However, since information can be updated as the device is rotated new information may have to be imported to the displayed section of the list and old information may have to be exported from the displayed section of the list.

According to some examples of the information presentation device an input and output longitudinal site may be defined and positioned parallel with the axis of rotation. The position of this site can be made to depend on rotation around the axis of rotation of the information presentation device.

List type data may thus be displayed on the information presentation unit. List type data comprises data that may be displayed as a list of items such as text, icons, figures, thumbnails, links, video clips, or the like.

The distance along the circumference of the information presentation unit, between two consecutive items in the list corresponds to the "line spacing" of the list, according to at least some examples of the information presentation device.

If rotation equals to or exceeds an angle of one line spacing, the position of the input/output site is updated, such that a new line will appear at one end of the displayed section of the list and one old line of the displayed section of the list can be shifted out of the displayed area.

Figure 2:
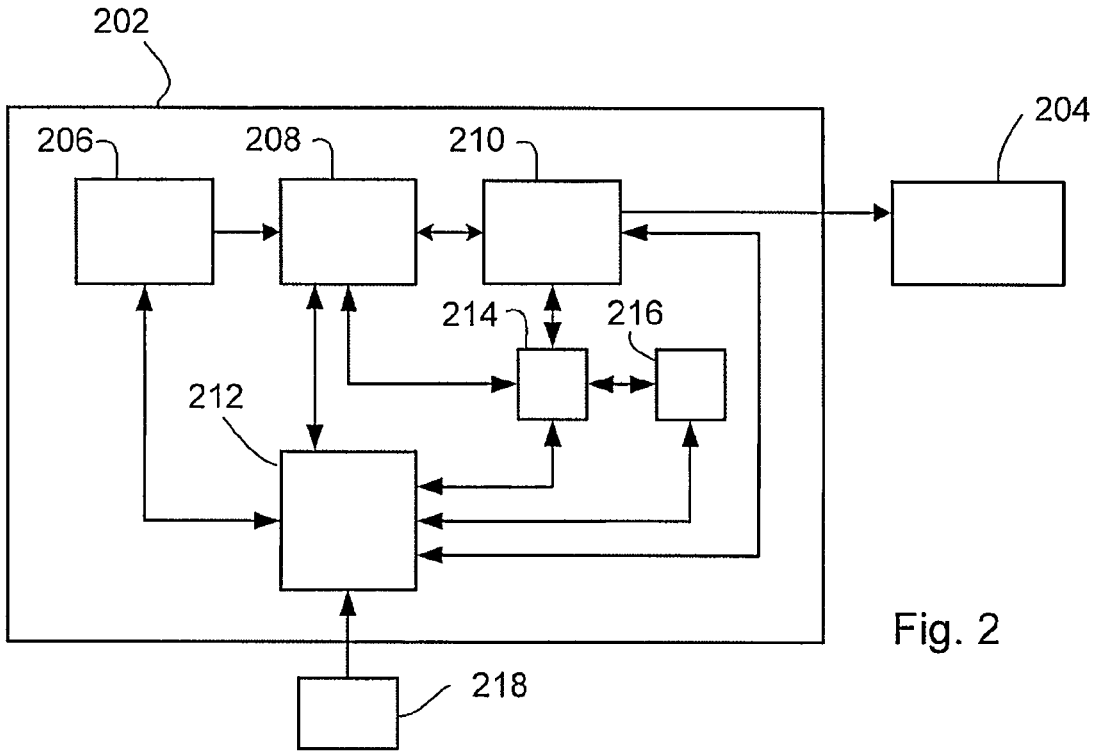
FIG. 2 illustrates a block diagram of a display controlling unit according to some embodiments of the present invention.

With reference to FIG. 2 illustrating a display controlling device 202 connected to a display 204, one example of a device for controlling the information displayed on the display is now presented.

Rotation around an axis of rotation may be detected by a rotation detection unit 206, which may be realised as a gravitation dependent unit that is arranged to detect rotation around an axis of rotation. In the case the information presentation device has an elongated shape the axis if typically the longitudinal axis.

An angle determining and evaluation unit 208 is provided after the rotation detection unit 206. The angle determining and evaluation unit, which in short may be called the angle unit, may determine the angle of rotation around the axis of rotation and evaluate whether any accumulated angle exceeds an angle of rotation that corresponds to the line spacing of the information as displayed on the display, or not.

The angle unit 208 is further connected to a display controlling unit 210, such as a driver unit, which further may have a direct connection to the display 204, as presented in FIG. 2.

A memory unit 214 may also be provided in the display controlling device 202 for providing data of the information to be displayed on the display. This memory unit 214 may be connected to the angle unit 208 and to the display controlling unit 210.

In addition, a control unit 212 may be provided to control the function of the rotation detection unit 206, the angle determining and evaluation unit 208, the display controlling unit 210 and the memory unit 214. Moreover a transceiving unit 216 may also be provided and connected to the control unit 212 as well as to the memory unit 214.

The user input unit 218 may also be connected to the control unit 212 of the display controlling device 202. This user input unit 218 may be used to activate a method for presenting list type information, such as a list of items or the like, on a display, and to be used to confirm that data positioned within the cursor area 108 are to be selected for further activities. The user input unit may also be used to activate other display related functions.

Figure 3:
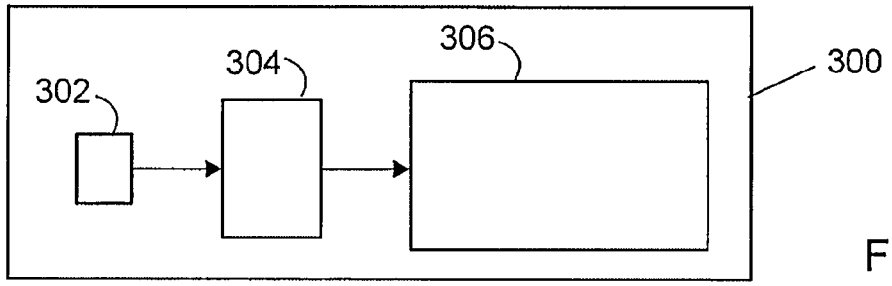
FIG. 3 illustrates an information presentation device according to some embodiments of the present invention.

FIG. 3 further illustrates an information presentation device 300 according to at least some embodiments of the present invention. The information presentation device 300, comprises a user input unit 302 connected to a display controlling unit 304, which further may be connected to an information presentation unit such as a display or a screen 306. According to at least some embodiments, the information presentation unit 306 covers the entire or substantially the entire envelope surface of the information presentation device 300, in the case of a rotation symmetrical shape of the information presentation device.

Figure 4:
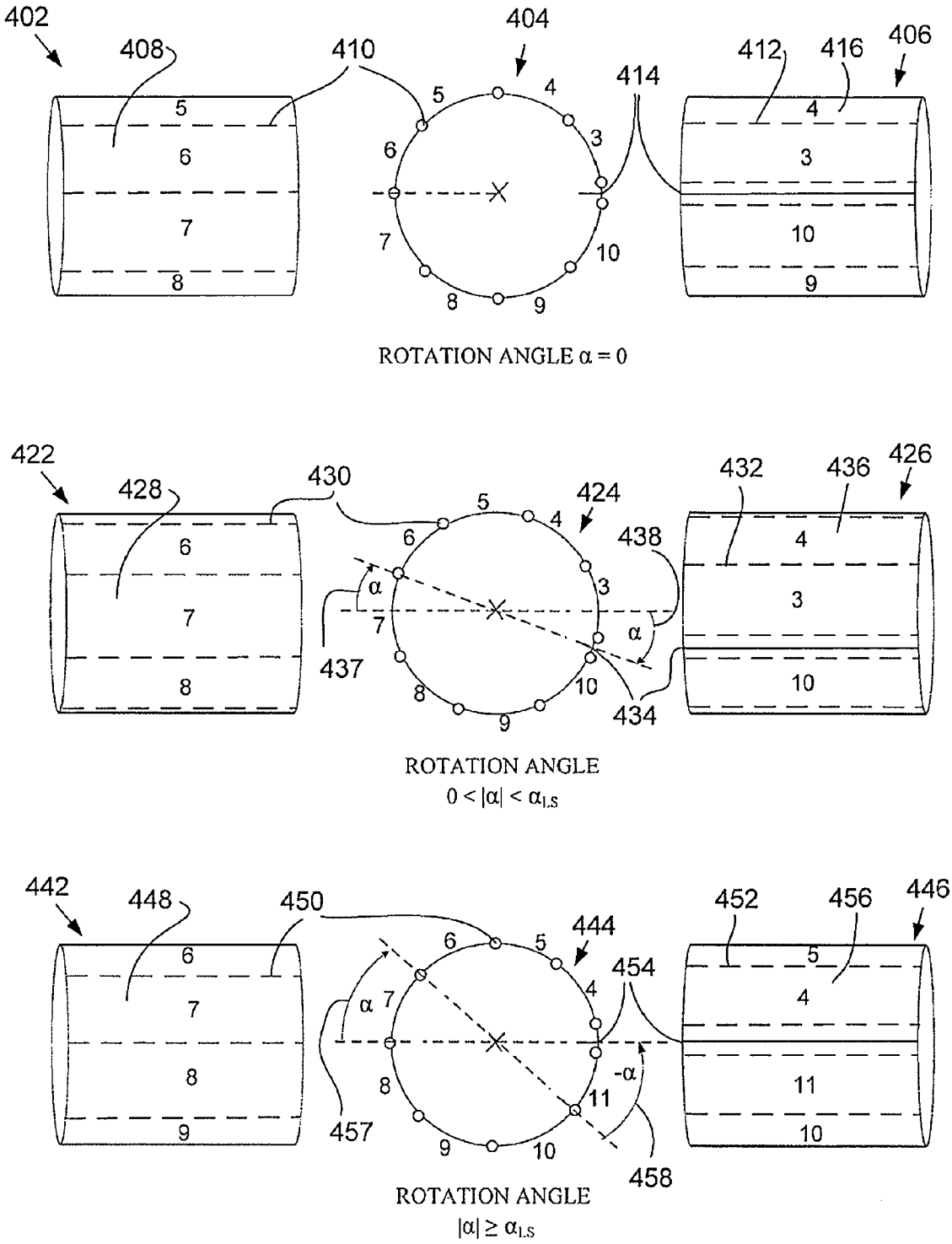
FIG. 4 illustrates an upper, a middle and a lower panel, each presenting one view along an axis of rotation, A, and two views perpendicular to said axis or rotation, A, of an information presentation device, of which the left hand view shows the information presentation device from the left hand side and the right hand view shows the information presentation device from the right hand side.

FIG. 4 illustrate a cylindrical information presentation device presented in three panels; an upper panel, a middle panel and a lower panel, where each panel presents the cylindrical information presentation device at one specific rotation angle, α. The cylindrical information presentation device is thus presented at three different rotation angles. The upper panel illustrates views of the information presentation device at a rotation angle α=0.

To the left is displayed a view 402 perpendicular to the longitudinal axis from the left, and to the right there is displayed a view 406 perpendicular to the longitudinal axis from the right. The dotted lines of the left 410 and right 412 views indicate line breaks, i.e. the spacing between two consecutive lines. The numbering 3, 4, 5, 6, 7, 8, 9, and 10 denote line information as being representative to list type information, of which items, icons, and thumbnails are only examples of a large variety of items that can be displayed on the information presentation unit.

In the centre of the upper panel there is illustrated an information presentation device 404 viewed essentially along the longitudinal axis. Here the line breaks are indicated with circles 410 separating the consecutive lines from one another.

The site for input and output (I/O) of line information 414 on the display is indicated on the left hand side of the centre representation and thus also appears on the right hand side view of the information presentation device 406. It should be emphasized that this site is merely a line at which the information as presented on the display may be shifted in and shifted out.

As the list type information is presented to be displayed from top and downwards on one side of the information presentation device that does not comprise the I/O site, the information as displayed near the I/O site is displayed upside down, as well as being discontinuous since the I/O site itself creates the context discontinuity.

The I/O site may not be clearly visible in case the information as displayed is presented such that the height of the display or screen, corresponds to an integer number of displayed item lines.

According to some embodiments of the present invention, the I/O site is a position at which information may be shifted out of the display and shifted in to the display, rather than being a physical hard ware display interruption.

Now, as the information presentation device is rotated by for instance a user holding the device in his or her hands and rolling the device to read or view further lines of list type items above or below the current view of the display, the rotation detection unit may detect rotation, which may start monitoring of the angle of rotation.

Rotation of the device enables a person to read or view the entire list material line by line. The updating of information may be performed by changing information for a fraction of the information as displayed on the information presentation unit. The fraction of displayed information that may be changed is the information presented around position of the I/O site.

In addition, the user will appreciate this by practical absence of jumping information on the display when reading or viewing the data when rolling or rotating the information presentation device. In reality, the list type information may appear to be fixed to the screen and therefore steady, in at least one mode of displaying information, which facilitates the reading by becoming less tiresome to a user's eyes when reading. This is in contrast to a normal screen, on which text jumps by one or more lines at a time when scrolling, which clearly becomes tiresome in the long run to a reader.

Now returning to FIG. 4 and the middle panel illustrating three views of an information presentation device at a non-zero rotation angle α. The rotation of the device is here smaller than the rotation angle corresponding to one line spacing. This angle is denoted $\alpha_{LS}$.

As was described for the upper panel, to the left is displayed a view 422 perpendicular to the longitudinal axis viewed from the left, and to the right there is displayed a view 426 perpendicular to the longitudinal axis viewed from the right. Again the dotted lines on the left 430 and right 432 views indicate line breaks, which again are virtual line breaks between two consecutive lines. Thus the numbering 3, 4, 6, 7, 8, and 10 denote line information as being representative to list type information.

In the centre of the middle panel there is illustrated the information presentation device viewed nearly along the longitudinal axis. Here the line breaks are indicated with circles 430 separating the consecutive lines from one another.

In the centre display the angle α is clearly illustrated and shows how the whole information presentation device is rotated an angle α. The line spacing breaks as well as the lines themselves are thus also rotated an angle α along the envelope surface of the display of the information presentation device.

In the view 422 on the left hand side, it can therefore be seen that the lines 6, 7 and 8 have been rotated with respect to the position of the lines 6, 7 and 8 as displayed in the upper panel on the left hand side as shown in view 402.

Similarly, it can be seen the line breaks and the lines 3, 4 and 10 as displayed in the middle panel on the right hand side as shown in view 426 have been rotated with respect of the position as displayed in the upper panel of FIG. 4 on the right hand side view 406.

It is clearly visualised that the I/O site 434 of the display 436 is rotated along with the display a rotation angle a around the longitudinal axis. The I/O site is thus no longer centred on the right hand side view 426 of the middle panel.

The right hand side view 426 shows that for a rotation angle α that is smaller than a rotation angle that corresponds to a line spacing of the list type information, $\alpha_{LS}$ as presented on the display, the position of the I/O site is rotated along with the entire display and no updating of information on the display is performed.

Now, focusing on the lower panel of the three panels displaying an information presentation device at three different views, the information presentation device has been rotated an angle α that at least corresponds to the line spacing angle $\alpha_{LS}$.

The left 442, right 446 and centre 444 views refer to different views of the information presentation device as explained above for the middle and upper panels.

In the centre view 444 is shown that the rotation angle α corresponds to the line spacing rotation angle $\alpha_{LS}$, as the line spacing mark between lines 7 and 8 in view 442 has taken the position of the line spacing mark between lines 6 and 7, as shown in the upper panel, left hand side view 402.

The left hand side view 442 of the information presentation device in the lower panel thus presents further rotated lines, showing information on lines 6, 7, 8 and 9. The position of each of these lines therefore corresponds to the position of the lines 5, 6, 7, and 8 in the upper panel, left hand side view 402.

On the right hand side view 446, the position of the I/O site is now discussed. As the rotation angle of the information presentation device α, corresponds to the line spacing angle $\alpha_{LS}$, a new line, line 1, of information is shifted in to the displayed area at the bottom of the displayed area. In addition, the first displayed line, line 3, is shifted out of the displayed area, bringing line 4 as the new first line of the displayed area. Together with the new line, line 11 being shifted in, the effect is that the I/O site is rotated an angle $\alpha$ in a direction opposite to an increasing angle $\alpha$ along the envelope surface. The angle of rotation of the I/O site in view 444 is therefore minus $\alpha$, since $\alpha$ may either be a positive angle or a negative angle.

As the position of the input/output (I/O) site is rotated in a direction opposite to increasing angle $\alpha$, the position on the display of the I/O site may be maintained in the centre of the display.

It should be clarified that the function of rotation of the I/O site may be switched off and again switched on. In a switched off mode, the position of the I/O site is not shifted and the information of the display may not be updated.

As the position of the I/O site is not rotated in the switched off mode, the I/O site can easily be rotated to the side of the display, being one example of the user presentation unit, that is directed away from the user holding the device, before switching on the information presentation device for updating of the display of said information presentation device.

Figure 5A:
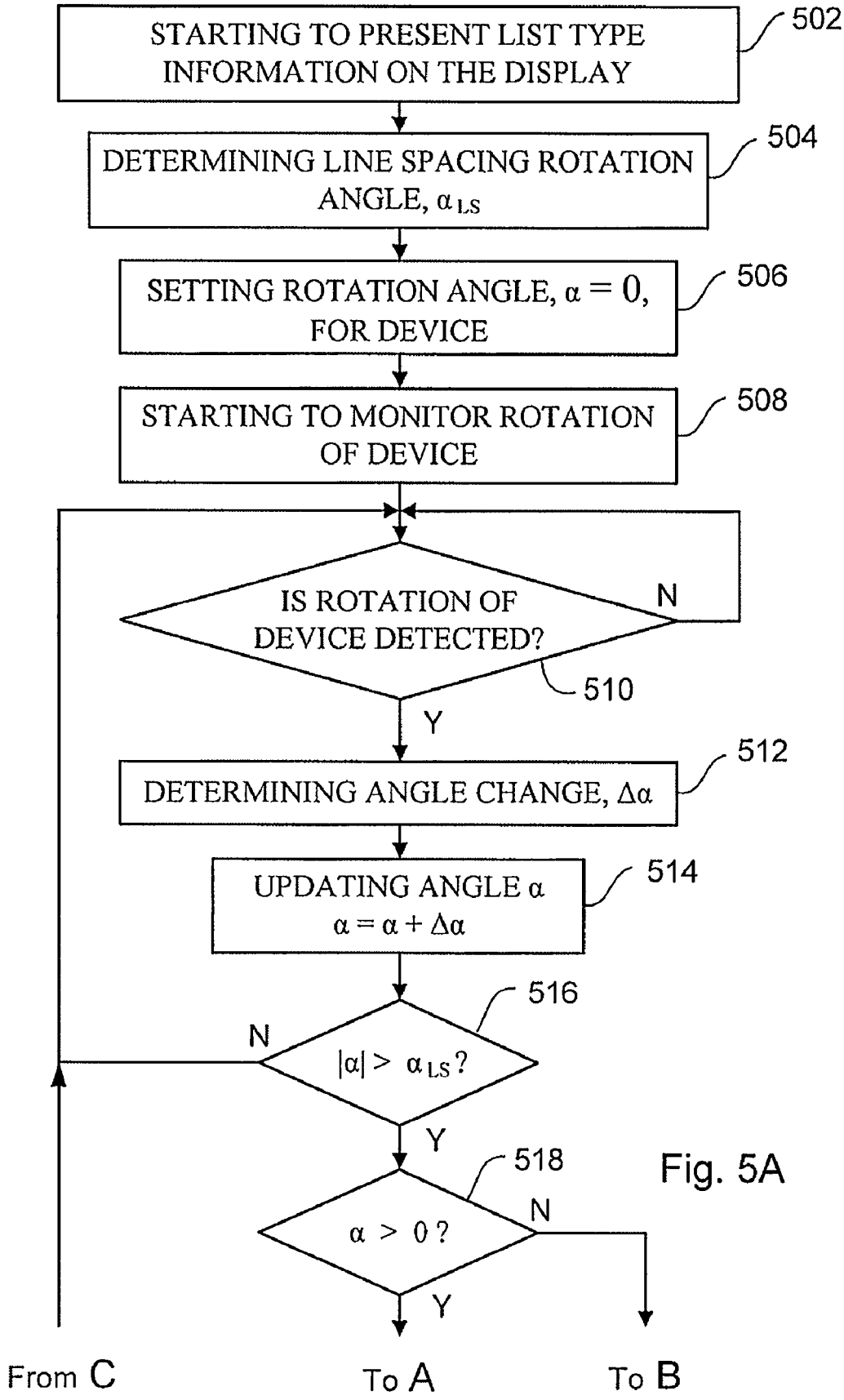
FIGS. 5A and 5B illustrate method steps of a flow chart related to updating of information for information presentation.
Figure 5B:
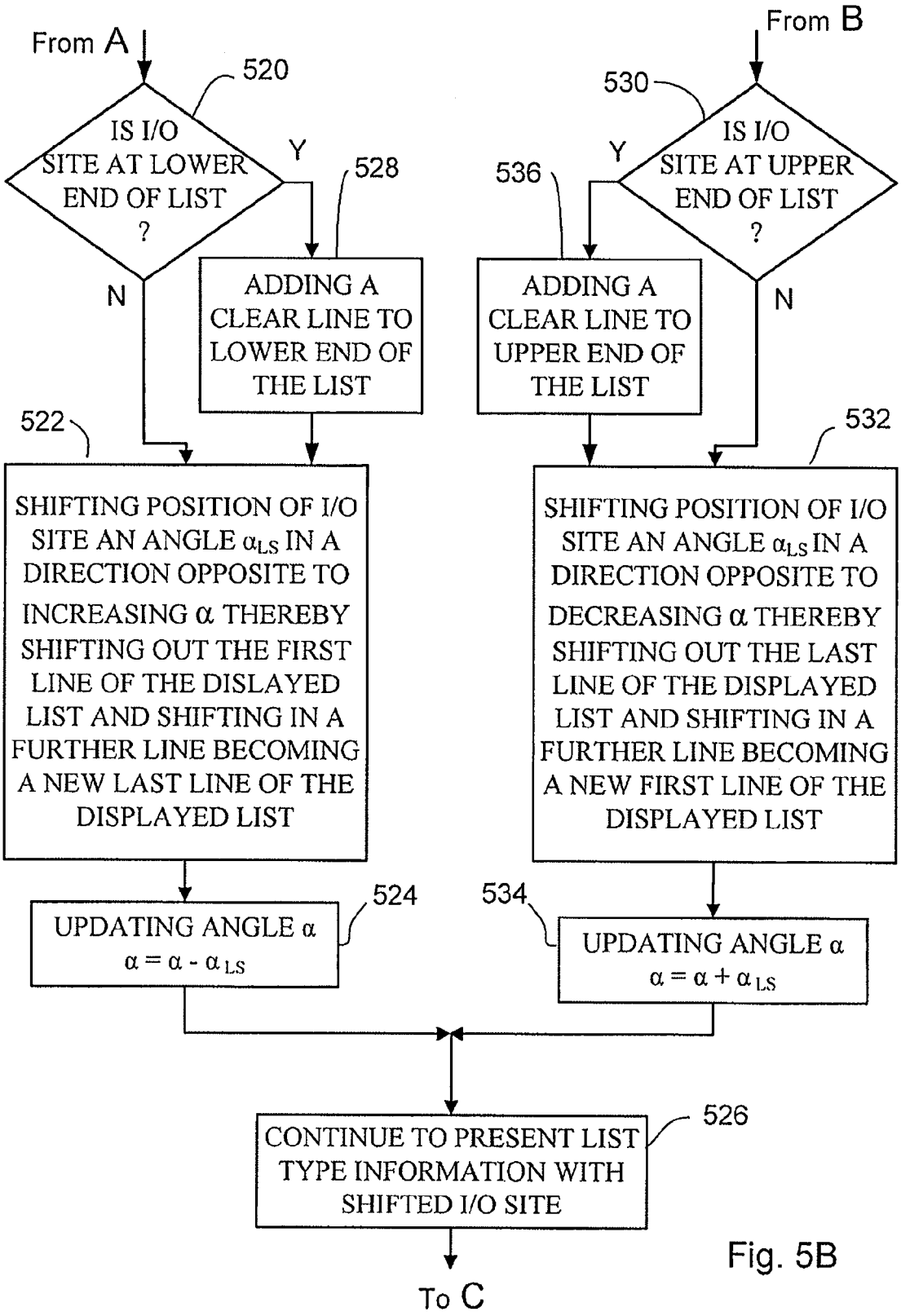

FIGS. 5A and 5B illustrate a method for updating of the position of the I/O site, which is described in more detail below.

According to at least some embodiments this method may start with step 502, starting to present list type information on an information presentation unit 102. Here the information presentation unit 102 comprises a display.

When presenting list type information, the rotation angle that corresponds to a line spacing distance along the envelop surface, $\alpha_{LS}$ of the information presentation device is now determined in step 504. This angle $\alpha_{LS}$ is thus the rotation angle that the rotation of one line around the longitudinal axis corresponds.

In the case the list type information comprises text type information, and is displayed with a small font size, the angle $\alpha_{LS}$ becomes relatively small, whereas in the case the font size is large, the angle $\alpha_{LS}$ becomes relatively large.

The following step may the step 506 of setting the rotation angle $\alpha=0$, i.e. zero, for the information presentation device. The angle $\alpha$ is reset to zero in order to start from a well-defined angle value.

Monitoring of the rotation of the information presentation device is started by step 508. From this step and on, rotation of the device is thus monitored and updating of the information of the display may be performed in dependence of the rotation of the information presentation device around an axis of rotation.

Rotation of the device is detected in the step 510, "Is rotation of device detected?" In the case rotation is detected, the angle change, $\Delta\alpha$, which is caused by the rotation is then determined. This is performed in step 512.

In case no angle rotation is detected in step 510, it is again determined in the following step whether a rotation is detected in the very same step, step 510, as shown in FIG. 5A.

If, however, a rotation actually is detected in step 510 and the rotation angle change determined in step 512, the angle alpha is updated at step 514, $\alpha=\alpha+\Delta\alpha$.

Having updated the angle $\alpha$, it is determined whether the updated rotation angle corresponds to the distance of a line spacing along the envelope surface of the device, and angle $\alpha_{LS}$. This is performed in step 516 where it is determined whether the absolute value of the angle $\alpha$ is larger than the line spacing angle $\alpha_{LS}$.

Since the information presentation device may be rotated around an axis of rotation in two directions, one being clockwise and the other being counter clockwise around an axis of rotation, it would not be enough to determine whether the information presentation device is rotated an angle that larger than the line spacing angle.

The information presentation device may equally well be rotated in the opposite direction such that the rotation angle $\alpha_{LS}$ becomes smaller than a negative line separation angle.

If the absolute value of the rotation angle $\alpha$ is not larger than the line spacing angle $\alpha_{LS}$, the next step in the method is then detecting whether rotation of the device is detected in step 510.

In the case where the rotation angle is positive and larger than the line spacing angle $\alpha_{LS}$, that is answering Y in step 518, the following step in the method is step 520, as illustrated in FIG. 5B, determining whether the I/O site is positioned at the lower end of entire list, or not.

A positive rotation angle change of the information presentation device is defined as the direction is which the device is rotated when reading from top and downwards of the list type information. Likewise, a negative rotation angle change is defined as the direction in which the device is rotated when reading the information from bottom and upwards.

As explained above, the I/O site is typically a site at which presented information may be shifted out and information to be presented may be shifted in.

The list type information to be displayed in the display, may commence with the top line of the entire list file. This top line equals to the upper end of the list. A corresponding bottom line of the entire list is thus the lower end of the list.

In step 520 it is determined whether the I/O site is positioned at the lower end of the entire list, or not. If the I/O site is not positioned at the lower end of the entire list, meaning that there is additional information to be switched in, the following step is the step at which the position of the I/O site is changed.

According to at least some embodiments, step 522 comprises shifting the position of the I/O site an angle $\alpha_{LS}$ in a direction towards decreasing $\alpha$ angle value. By shifting this I/O site the first line of the displayed list is shifted out. Also, a further line is shifted in becoming a new last line of the displayed list.

Returning to the information presentation device as displayed at three different rotation angles, it is illustrated when comparing the upper panel and the lower panel, that the first line, being line 3, of displayed list of the right hand side view 406 of the upper panel, is switched out and line 11 is shifted in to the displayed area, as illustrated in the lower panel in the right hand side view 446 of FIG. 4.

Having shifted the I/O site position, the angle $\alpha$ is updated in step 524, performing $\alpha=\alpha-\alpha_{LS}$. After the alpha $\alpha$ is updated the next step to execute may be step 526, continuing to present list type information, but now with a shifted I/O site position.

Subsequent to presenting the information on the display with an updated I/O site position, step 510 is performed by determining whether rotation of the device is detected or not.

Returning to FIG. 5B and the case in which the I/O site is positioned at the lower end of the list, there is no additional information to be switched in to the displayed. When the question in step 520 is answered by a "Y", the following step may therefore be step 528 of adding a clear line to the lower end of the list. The list of items is thus prolonged with one clear line or item from below. This is performed in order to avoid presenting the I/O site to the user rotating the information presentation device in step 526, as repetitive shifting of information else could risk displaying the I/O site to the user.

It should be clarified that the clear line is added to the lower end of the list itself, rather than to the information as presented on the information presentation device. The clear line is therefore displayed in the displayed area, after shifting of the I/O site has been performed.

In the case the information presentation device is rotated, by for instance a user, in the direction for which the angle $\alpha$ is negative, that is when rolling or rotating the device around an axis of rotation from the bottom of the display area to the top of the display area, the angle change is negative and the accumulated angle $\alpha$ may become negative in step 518.

Following the alternative B to FIG. 5B, the next step to the performed is determining whether the I/O site is positioned at the upper end of the entire list, in step 530.

In case the I/O site is already positioned at the upper end of the list, as determined in step 530, the following step is adding a clear line to the upper end of the list, in step 536. As described in connection to step 528, the clear line as added to the list itself. The clear line is then shifted into the displayed area in step 532, when the information is updated around the I/O site, in the way as earlier described.

However, if it is determined that the I/O site is not positioned at the upper end of the entire list, the following step is step 532 at which shifting of the I/O site is performed. In this step, shifting is performed in a direction opposite to the direction as described in step 522. In step 532 the I/O site is shifted an angle $\alpha_{LS}$ in a direction opposite to the direction of decreasing angle $\alpha$. The absolute value of the angle $\alpha$ is thus decreased. The last line on the display is thus shifted out. In addition, shifting in of a further line that is becoming a new first line on the display is hence also performed, in step 532.

Having performed the shifting of the I/O position, the angle $\alpha$ is updated in step 534 by updating the angle $\alpha$ by setting $\alpha=\alpha+\alpha_{LS}$.

After the alpha $\alpha$ is updated the following step is to continue presenting the list type information with the shifted I/O site in step 526, as illustrated in FIG. 5B. As explained above, subsequent to step 526 it is again determined whether rotation of the device is detected, or not in step 510, as illustrated in FIG. 5A.

According to an alternative example, the position of the I/O site may be shifted when the absolute value of the angle of rotation is larger than a part of a full turn, for instance a quarter of a turn.

Moreover, it is realized that the information presentation device can be turned and rotated in any direction, for which reason list displayed close to the I/O site may be turned around to be displayed from top and downwards. The opposite side of the information presentation device, which now does not comprise the I/O site, is then displayed upside down, as only one side at a time may be displayed from top and downwards.

The I/O site may be shifted whenever the absolute value of the rotation angle alpha exceeds alpha LS. In the case of the I/O the alpha LS may be the angle corresponding to a singular pixel distance around the circumference of the information presentation device. In the case of the I/O the alpha LS may alternatively related to the distance between two consecutive items displayed on the information presentation unit.

The information presentation device can thus easily be turned again such that displayed information is shown without the presenting the I/O site on the viewed side.

In addition, the information presentation device function as described herein may be inactivated or switched off as indicated above, possibly for presentation of material different from list type material on the display. In a switched off mode, updating of the screen will thus not be performed, as the device will not respond to rotation around any axes.

The information as presented on the information presentation unit may be updated on a more continuous basis, as compared to what has been described above. The line spacing distance may be defined as the distance between two consecutive pixels along the circumference or the envelope surface of information presentation device. By shifting information in and out at the I/O site per line of pixels, a "smooth scroll" experience may be provided to a person towards whom the I/O-side of the information presentation device is directed.

It is clear from the above that rotation of the information presentation device is central to the updating of information or rather position of information on an information presentation unit, such as a display or a screen of an information presentation device.

In FIGS. 6A to 6D there are illustrated four views of an information presentation device along an axis of rotation, according to some embodiments of the present invention.

Reference will be made to these figures in the description below, where it will be described the usage of rotation motion to update the presentation of information as presented on the display. Two modes of updating of presentations have here been defined. Further modes of updating of information may however easily be anticipated, wherein the rotational motion may be used to update the presentation in various ways.

Figure 6A:
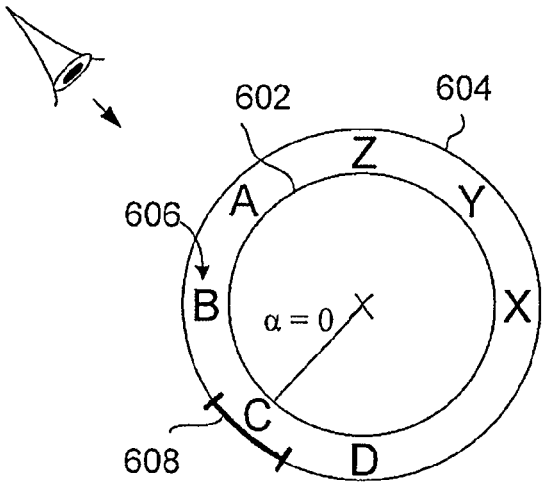
FIGS. 6A-D illustrate four views along an axis or rotation of an information presentation device according to some embodiments of the present invention.

In FIG. 6A it is thus illustrated a side view of an information presentation device along an axis of rotation. The information presentation device typically comprises an information presentation unit, as described above. In FIG. 6A, an information presentation unit is depicted by 602, whereas the information to be presented on the display is denoted by 604.

Information to be presented on such a display may comprise content-rich information portions and content-poor information portions, which may be provided in the information in an alternating fashion, after one another. One example of content-rich information is the text line B, as denoted by 606.

At another content-rich information portion position it is presented a selection area denoted with 608. This selection area may be an area, which may be used for selection of options prior to activation of a selected option, for instance. As will be described below the functions that are possible to activate may be dependent on user input as obtained from a user input unit, and provided by a user of the information presentation device.

A user input unit may hence be used to confirm that data positioned within a cursor or selection area, for instance, are to be selected for further activities. Of course, other display related functions might also be controlled by using input from the user input.

As will be described below the position of the cursor area on the information presentation unit, may also be dependent on the rotation of the information presentation device, according to at least some embodiments of the present invention.

Figure 6B:
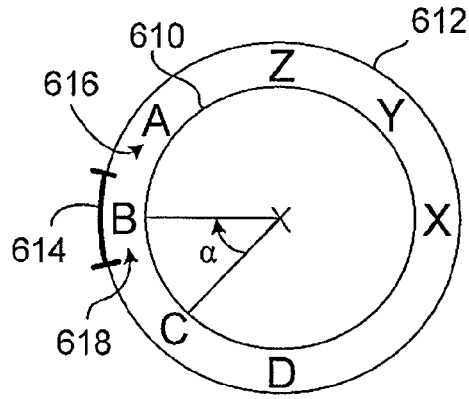
Figure 6C:
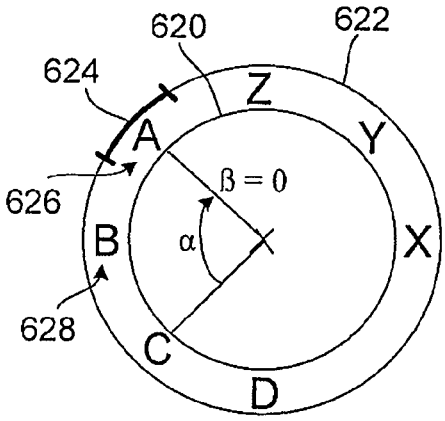
Figure 6D:
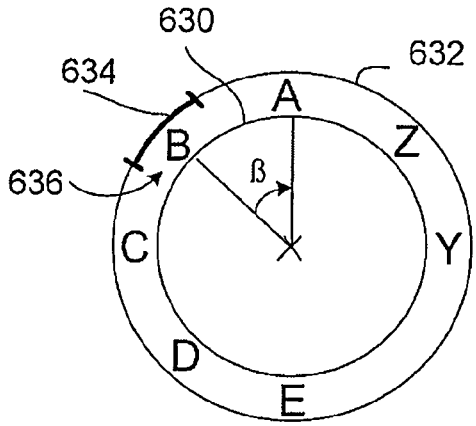
Figure 7A:
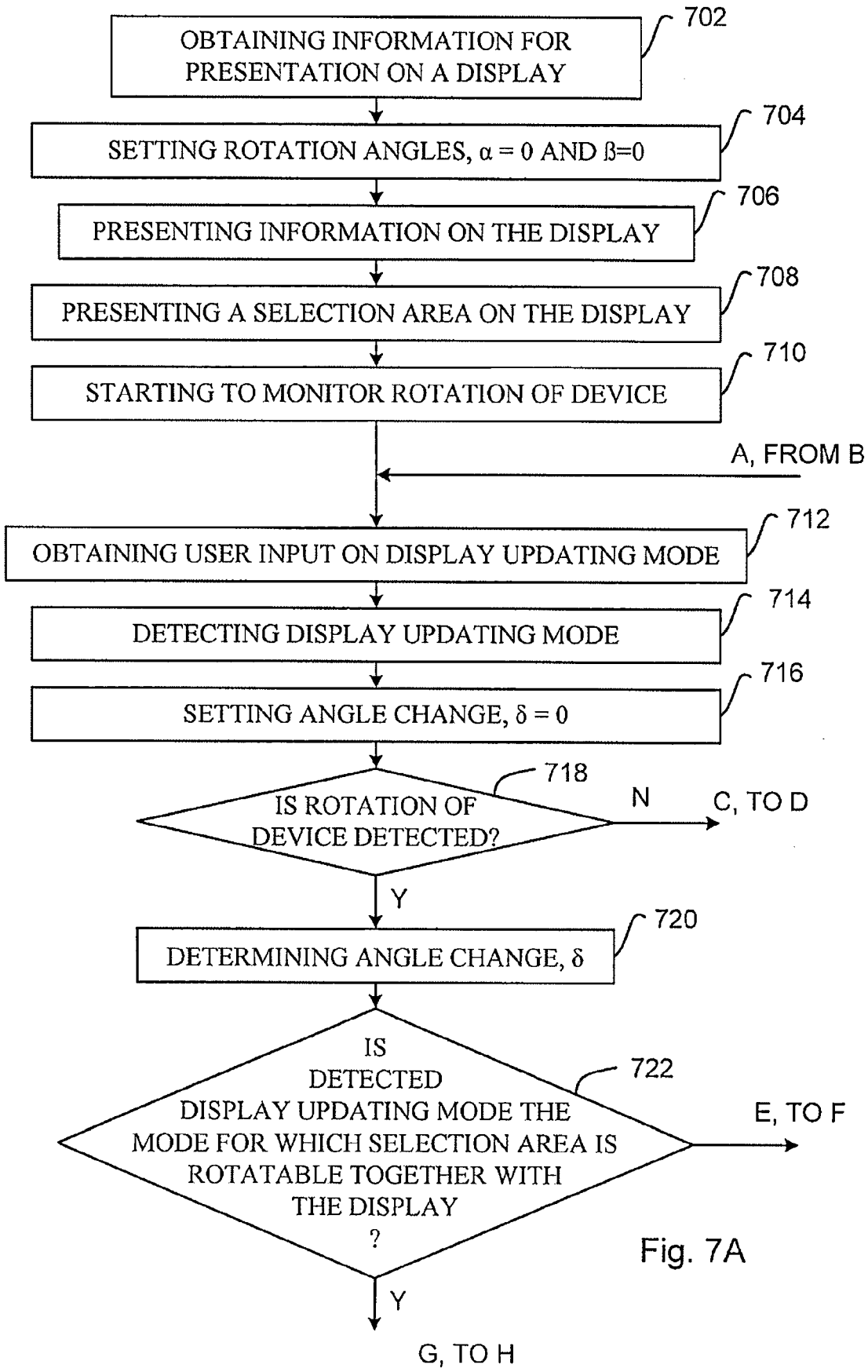
FIGS. 7A-B illustrate method steps of a flowchart according to some embodiments of the present invention.
Figure 7B:
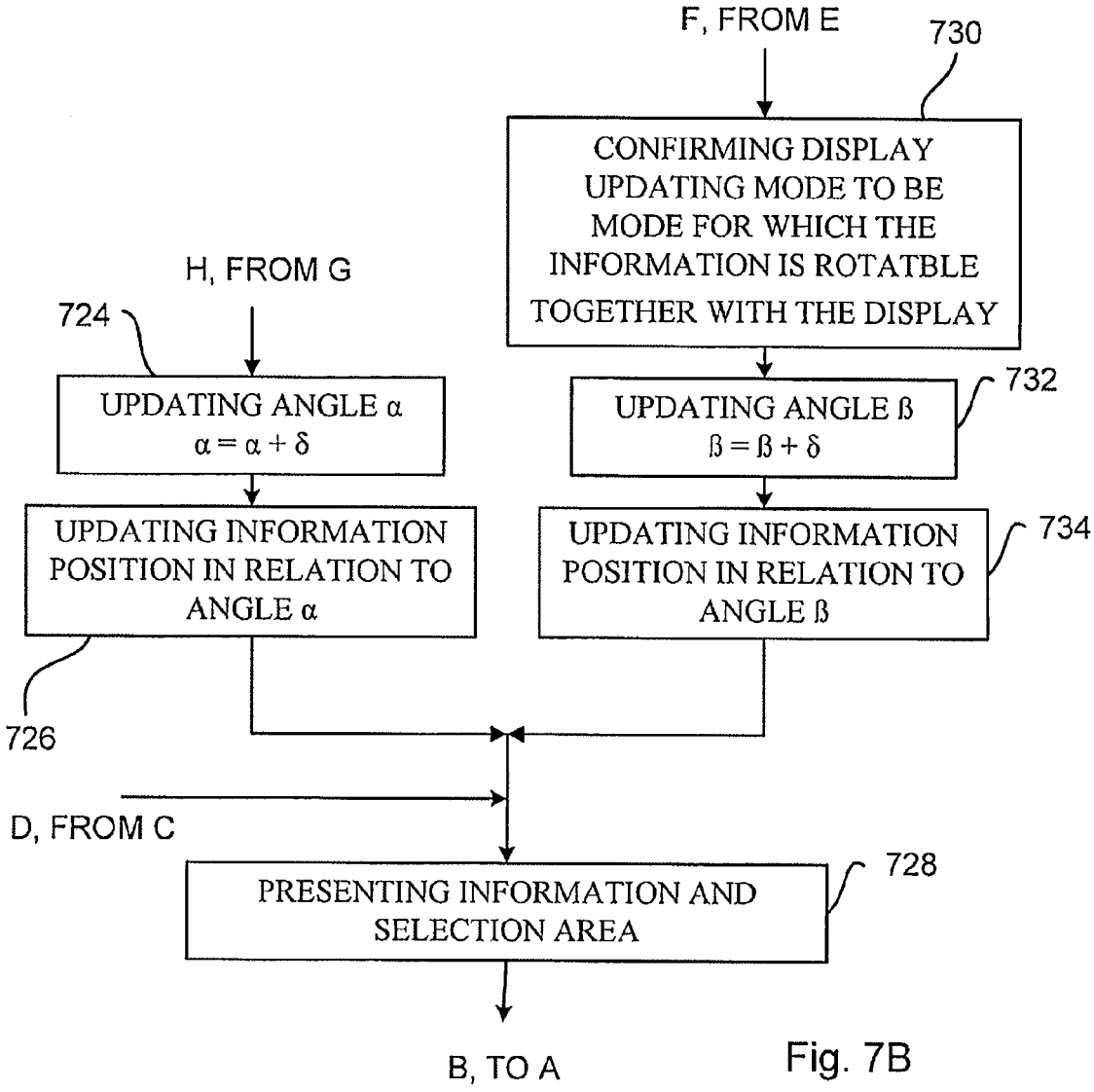

While describing the various views of the information presentation device as illustrated in FIGS. 6A-D, reference is also made to FIGS. 7A and 7B illustrating a flow-chart with method steps of updating the presentation of information on a information presentation device.

The method may start with step 702 of obtaining information to be presented on a display, as one example of an information presentation unit, of an information presentation device.

Initially rotation angles that are used in two different updating modes, are set to zero (=0) in the step of 704. Other values may be used in an alternative embodiment.

The following step is the step of presenting information on the display, which may the surface as denoted by 602 in FIG. 6A. The information in general is thus denoted by 604, and one content-rich information portion by 606, comprising "B".

Information is thus presented on the display 602.

Next step is the step of presenting a selection area on the display, step 708. In FIG. 6A this selection area is denoted by 608, which here happen to cover the information portion "C".

The method for updating the presentation now comprises, step 710, starting to monitor rotation of the device. This is performed in order to enable updating of the display in dependence of a rotation around a rotation axis as performed by a user of the information presentation device.

The next step is obtaining user input on display updating mode in step 712. In this step, the device may obtain a user selection of a user input unit, for instance obtaining whether a switch is positioned in a first or a second position. A multiple of different positions may however be realized, according to alternative embodiments.

Having obtained input from a user on the display updating mode, it is next detected the actual mode in step 714, detecting display updating mode.

In a following step, the angle change $\delta$ is set to zero (0). This is performed in order to facilitate updating angle $\alpha$ or $\beta$ in small incremental steps.

In step 718, it is determined whether rotation of the information presentation is detected, or not. If it is determined that the device is rotated, the rotation angle change $\delta$ is determined, in step 720.

As the actual display updating mode was detected in step 714, it can now be determined in step 722 whether the detected display updating mode is the mode for which the selection area is rotatable together with the display, or not. It is thus determined whether the selection area is to follow a rotation of the device or not.

If the interrogation can be answered by a "Y" in step 722, the proceeding step is step 724, which is presented in FIG. 7B, updating angle $\alpha$ by performing $\alpha=\alpha+\delta$. The angle $\alpha$, which may define the position of the selection area, is thus updated.

The following step is then the step of updating the information position in relation to angle $\alpha$, including the selection area, in step 726.

Having updated the information position in step 724, the information can be presented on the information presentation unit, such as the display, in step 728, presenting information and selection area.

One example of such a presentation is illustrated in FIG. 6B in which information 612 is presented on an envelope surface of an information presentation unit, such as a display or a screen, 610.

As can clearly be seen, the position of the selection area is changed in relation to the illustration in FIG. 6A. The angle $\alpha$ is updated from the value (=0) in FIG. 6A, for which reason the angle can be visualized by the angular distance between the content-rich information portions "C" and "B", in this example.

The position of the selection area has thus changed. The selection area is now positioned at the same horizontal height as the rotation axis, which is different from the position of the selection area in FIG. 6A, which was clearly below the one for the rotation axis and oriented downward. Since users typically view items at an angle downward, providing a selection area oriented downward may not be preferred. For this reason an updating of the position around the envelope surface of the selection area is provided. As illustrated in FIG. 6B, the position of the selection area is now updated.

It should be clarified that updating of the selection area is performed by rotating the information presentation device. In the display updating mode for which the selection area is rotatable together with the display, being one example of the information presentation unit, the selection area is updated. The information content as presented by the information presentation unit, as illustrated in FIG. 6B, is in this example however not updated in relation to, for instance the horizontal height as compared to the rotation axis.

It should be kept in mind that an updating of information position may be performed in a different way, according to an alternative embodiment. According to this alternative embodiment, the information as presented on the display may be rotated in a direction counter to the rotation direction of the information presentation device. Thus, when rotating the device an angle $\alpha$, the information as presented on the display may be rotated an angle $-\alpha$, in relation to the display. Irrespective of the size of the rotation of the device, the impression of the display when viewing it would be that the information is remained at its position. The real display has of course been rotated and in this example also the selection area, in order to change the position of it in relation to the information as presented on the display.

Returning to the method of updating information, having presented the information and the selection area in step 728, the next step for a continuous process is the step of obtaining user input on display updating mode, step 712. As earlier indicated this step may be to check in which position a user input device is set, to mention one possible example.

The following two steps are thus steps 714 and 716, detecting display updating mode and the step of setting angle change to 0, respectively, as described above.

If rotation of the information presentation device is not detected in step 718, the next step 728 to continue to present information and the selection area, as presented in beforehand.

If however rotation is detected in step 718, the angle change determined in step 720 and the display updating mode is the mode in which it is determined that the selection area is rotatable together with the display in step 722, the following steps are steps 724 and 726, which are ended by step 728, presenting information and selection area.

One example of such a presentation is illustrated in FIG. 6C, in which the selection area 624 is updated to cover the content-rich information portion 626 of the information 622 as presented on the information presentation unit 620.

The position of the selection area is thus updated by updating the angle $\alpha$ in step 724, thus providing the selection area at a position on the display where it is more easily viewable by a user.

Presenting the information and the selection area in step 728, the steps to proceed are steps 712, 714 and 716, until it is detected in step 718 that the device is rotated. The angle change $\delta$ is determined in step 720.

In step 722, it may however be determined the detected display updating mode is not the mode in which the selection area is rotatable together with the display upon rotation.

For this reason, it can be confirm the proceeding step that the display updating mode is the mode in which the information is rotatable together with the display, in step 730.

In this mode the presented information that may comprise content-rich and content-poor information portions, is rotated along with a physical rotation of the information presentation device. The impression of such a rotation is that the information seems to be fixed on the display. As can be clearly understood, this is firstly mere an impression, and secondly this is one mode of presenting information, out of at least one more mode, which was described above in relation to FIGS. 6A and 6B.

Having confirmed the display updating mode in step 730, the step of updating the angle β in step 732 is performed by setting β=β+δ, where δ is the angle change as determined in the prior step 720.

It should be mentioned that step 730 of confirming the display updating mode maybe regarded to be step for clarifying the illustration of the flow-chart only and may in reality not be performed in case the number of possible modes to update information as presented on the display is limited to two.

With an updated angle β as determined in step 732, the step of updating the information position in relation to angle β is now performed in step 734.

It can be noted that an updating of step 734 may also be performed in relation to angle α, just as the step of updating information position in step 726 may also be performed in relation to angle β.

Having performed the step of updating the information position, the step of presenting information and selection area may be performed in step 728.

One example of such a presentation is schematically illustrated in FIG. 6D, in which an information presentation device is presented along a rotation axis.

The cylindrical or essentially cylindrical envelope surface of the information presentation unit is denoted by 630 and the information that may comprise content-rich information portions and content-poor information portions is denoted 632.

It is seen that the information as displayed on the information presentation unit is now positioned at a new position in relation to the horizontal height of the rotation axis. The content-rich information portion "A" is now presented topmost of the display.

The position of the selection area is however not updated in the sense that the selection area is positioned at about the same position as the selection area of FIG. 6C.

Upon detecting a display updating mode for which the presented information is to be rotated together with the device, the information will follow the rotation of the device, just as if the information was fixed on the screen.

It should again be mentioned, that updating of presented information might be performed according to alternative embodiments. According at least one of these alternative embodiments, the selection area as presented on the display may be rotated in a direction counter to the rotation direction of the information presentation device. Thus, when rotating the device an angle β, the selection area as presented on the display may be rotated an angle −β, in relation to the display. Irrespective of the size of the rotation of the device, the impression of the display when viewing it would be that the selection area is remained at its position relative to the exterior to the device. The real display has of course been rotated and in this example also the information, in order to change the position of it in relation to the information as presented on the display.

It may be added that the selection area may initially be positioned at a position of the information presentation device, which is diametrically opposite to an input/output site that was earlier described in some detail.

On real displays the position of the selection area may be updated when the distance correspondence of the rotation angle α exceeds the distance between two consecutive pixels along the circumference of the information presentation device.

Having presented a method for controlling presentation of information by referring to the steps of FIG. 7, an information presentation device for presentation of information at least according to some embodiments will now be described.

An information presentation device according to some embodiments of the present invention comprises an information presentation unit, a user input unit and a presentation controlling unit for controlling of the presentation of information onto the information presentation unit.

It should be pointed out that the display controlling device 202 as depicted in FIG. 2, may be adapted to perform the method steps of the flow-chart as presented in FIG. 7. For this reason reference is made to FIG. 2.

The step of obtaining information for presentation on a display, step 702, may be performed by the transceiving unit 216. The step of setting the rotation angles α and β to zero, step 704, may be performed by the angle determining and evaluation unit 208. The steps of presenting information on the display, step 706, and the step of presenting a selection area on the display, step 708, may be performed by the display controlling unit 210, which may be a display driver unit, in connection with the display 204.

The step of starting to monitor rotation of device, step 710, may be performed by the rotation detection unit 206 in connection with the control unit 212. Obtaining user input on display updating mode, may be performed from the user input unit 218 under the control of the control unit 212.

The display controlling unit 210 may detect the display updating mode in step 714, whereas the angle determining and evaluation unit 208 may perform setting angle change δ=0, in step 716.

Step 718, determining whether rotation is detected or not may be performed by the rotation detection unit 206, and step 720, determining angle change δ may be executed by the angle determining and evaluation unit 208.

Since the display controlling unit 210 might have performed step 714, it may also perform step 722, determining whether the detected display updating mode is the mode for which the selection area is rotatable together with the display, or not.

The step of confirming the display updating mode to be the mode for which the information is rotatable together with the display, step 730, if desired, may also be performed by the display controlling unit 210.

The steps of updating the angle α and angle β, in steps 724 and 732, respectively, may be performed by the angle determining and evaluation angle 208.

It can be noted that the angle determining and evaluation angle 208 may alternatively be called the angle unit 208.

The steps of updating information position in relation to angle α and angle β, as performed in steps 726 and 734, respectively, may be performed by the display controlling unit under the control of the control unit 212.

Moreover, the step of presenting information and selection area on the display, step 728, can be executed by the display controlling unit, 210 in connection with the display unit 204.

A few of these cited steps may however be performed by a unit different from the one described. The control unit my for instance have alternative tasks to perform. As the presentation controlling unit thus can be adapted to perform another method, additional control functions may be provided by the control unit according to at least some embodiments of the present invention.

According to some embodiments of the present invention, the presentation of information may be dependent of the display updating mode in a way such that when the mode is the one for which the selection area is rotatable together with the display, then the information presentation unit may present empty space as information. In other the information presentation unit will present the selection area only and no real information. When the display updating mode is changed to the mode for which the information is rotatable together with the display, then the information will be presented as well, in addition to the selection area.

It is thus easy to understand that the embodiments come with a multiple of advantages of which a few are:

Enabling changing the position of the selection area in relation, provides the advantage that a user can more easily make use of such functionality for, for instance, selecting data positioned within the selection area for further activities.

Information or the selection area may appear as fixed to the display, as an effect of small updating steps, and will hence not jump upon updating of the presentation of the information presentation unit. This is much appreciated by a user since updated information and selection area will not be experienced as tiresome for a user's eyes.

It is emphasized that the present invention can be varied in many ways, of which the embodiments as presented are just a few examples. These embodiments are hence non-limiting. The scope of the present invention is however, limited by the subsequently following claims.

The invention claimed is:

1. An information presentation device for presentation of data information, the information presentation device comprising:

an information presentation unit arranged to present data information to a user, a user input unit for receiving user input, and a presentation controlling unit connected to the information presentation unit, said presentation controlling unit being arranged to control the presentation of the information on the information presentation unit, and arranged to present a selection area related to the presented information, wherein either the data information or the selection area is presented in dependence of physical rotation around an axis of rotation of the information presentation device, in dependence of user input.

2. The information presentation device according to claim 1, wherein the presentation controlling unit further is arranged to determine physical rotation around the axis of rotation of the information presentation device and arranged to position the selection area in dependence of the determined rotation.

3. The information presentation device according to claim 1, wherein the presentation controlling unit further is arranged to determine physical rotation around the axis of rotation of the information presentation device and arranged to provide the presentation of information in dependence of the determined rotation.

4. The information presentation device according to claim 1, wherein the information presentation unit comprises a substantially rotation symmetric shape around the axis of rotation, and where the information presentation unit covers at least substantially the entire turn around the envelope surface of the rotation symmetric shape.

5. The information presentation device according to claim 1, wherein said information presentation device is comprised in a mobile phone.

6. A method for controlling an information presentation unit adapted to present data information, comprising the steps of:

obtaining information to be presented on an information presentation unit, presenting information on the information presentation unit, presenting a selection area on the information presentation unit, determining mode for updating information on information presentation unit, in dependence of user input, detecting a rotational motion around an axis of rotation of an information presentation device, and providing either the selected area at an updated position on the information presentation unit or the presented information at an updated position on the information presentation unit, in dependence of the detection of rotational motion and in dependence of obtained user input, enabling the selection area or the information to rotate according to detected rotational motion around an axis of rotation of the information presentation device.

* * * * *

UNITED STATES PATENT AND TRADEMARK OFFICE

CERTIFICATE OF CORRECTION

PATENT NO. : 8,207,910 B2
APPLICATION NO. : 12/256983
DATED : June 26, 2012
INVENTOR(S) : Kuiken et al.

It is certified that error appears in the above-identified patent and that said Letters Patent is hereby corrected as shown below:

Specification, Column 6, line 66, replace "$\alpha_{LS}$, a new line, line 1, of information is shifted in to the" with --$\alpha_{LS}$, a new line, line 11, of information is shifted in to the--.

Signed and Sealed this
Fourteenth Day of August, 2012

David J. Kappos

David J. Kappos
*Director of the United States Patent and Trademark Office*